United States Patent [19]

Hult et al.

[11] Patent Number: 4,864,681

[45] Date of Patent: Sep. 12, 1989

[54] MULTI-PURPOSE FLOOR CLEANING TOOL

[75] Inventors: David R. Hult; Mark J. Tomasiak, both of St. Charles County, Mo.

[73] Assignee: Emerson Electric Co., St. Louis, Mo.

[21] Appl. No.: 208,766

[22] Filed: Jun. 20, 1988

[51] Int. Cl.[4] ..... A47L 9/06

[52] U.S. Cl. ..... 15/367; 15/398; 15/401; 15/416

[58] Field of Search ..... 15/416, 417, 401, 398, 15/364, 367

[56] References Cited

U.S. PATENT DOCUMENTS 2,844,841 7/1958 Bergquist ..... 15/417
2,857,615 10/1958 Anderson ..... 15/417 X
2,867,835 1/1959 Brown et al. ..... 15/417 X
3,029,461 4/1962 Osborn ..... 15/417 X

*Primary Examiner*—Chris K. Moore
*Attorney, Agent, or Firm*—Polster, Polster and Lucchesi

[57] ABSTRACT

A multi-purpose floor cleaning tool for use in picking up or collecting wet or dry media is disclosed, and includes a first passageway connecting a first side of the tool to a vacuum line, a second passageway connecting a second side of the tool to the vacuum line, and an adapter for optionally closing off the second passageway during use of the first passageway or for closing off the first passageway during use of the second passageway. One of the passageways is used exclusively for dry media whereas the other passageway is used exclusively for wet media. This requires re-positioning of the tool for the proper orientation of the dry or wet media passageway, as desired.

11 Claims, 4 Drawing Sheets

MULTI-PURPOSE FLOOR CLEANING TOOL

BACKGROUND OF THE INVENTION

The present invention relates to a multi-purpose floor cleaning tool, and more particularly, to multi-purpose floor cleaning tool for use in picking up or collecting wet or dry media, as desired.

Current vacuum cleaners have separate floor cleaning tools which are used for picking up or collecting either dry or wet media. By definition as described herein, dry media includes dust and other particles on floor and carpet surfaces, and wet media includes water or other liquids on floor surfaces.

At the present time, individual cleaning tools are used for collecting dry or wet media from floor or carpet surfaces. This is due primarily to the fact that current floor cleaning tools cannot be used for both dry and wet media. If a dry media floor cleaning tools gets wet, it is not usable for collecting dry media, and vice versa. Thus, present floor cleaning tools are separate, individual floor cleaning tools or products that are used for cleaning and/or collecting either dry or wet media from floors.

It will be appreciated that having a series of separate dry media or wet media floor cleaning tools, for use with vacuum cleaners, is not only costly, but requires extra time and energy in replacing a dry media floor cleaning tool with a wet media floor cleaning tool and vice versa. This makes current separate dry and wet media floor cleaning tools burdensome and inconvenient to use. At the same time, because of a need to keep dry and wet media collection separate from one another, there has been no practical way of avoiding the burdensome and inconvenient task of replacing individual or cleaning tools for picking up or collecting wet or dry media, as may be desired.

SUMMARY OF THE INVENTION

Accordingly, among the several objects and advantages of the present invention include:

the provision of a multi-purpose floor cleaning tool for vacuum cleaners to be use in picking up dry or wet media, as desired;

the provision of the aforementioned multi-purpose floor cleaning tool that is readily interchangeable for wet or dry media collection, and at the same time eliminates the need for separate individual wet and dry media tools;

the provision of the aforementioned multi-purpose floor cleaning tool which provides optional use of the either a dry media passageway or a wet media passageway, so as to maintain the separateness of the passageways for proper functioning, while affording optional or interchangeable use of one or the other, as may be desired;

the provision of the aforementioned multi-purpose floor cleaning tool which affords quick and easy conversion for use either as a wet or dry media collecting tool by simply re-connecting and re-positioning the same components forming the multi-purpose floor cleaning tool;

the provision of the aforementioned multi-purpose floor cleaning tool which releasably engages, and disengages components of the multi-purpose floor cleaning tool in a different orientation for rapid and convenient conversion of the multi-purpose floor cleaning tool, as either a dry or wet media floor cleaning tool; and the provision of the aforementioned multi-purpose floor cleaning tool which is simple and easy to use, quickly converts for use as either a dry or wet media tool, eliminates burdensome and inconvenient tasks, is economical, is durable and long lasting, and is otherwise well-adapted for the purposes intended.

Briefly stated, the multi-cleaning tool of the present invention is adapted for use in picking up wet or dry media, as desired. The multi-purpose floor cleaning tool includes a first passageway connecting a first side of the tool to vacuum line, a second passageway connecting a second side of the tool to the vacuum line, and an adapter for optionally closing off the second passageway during use of the first passageway or for closing off the first passageway during use of the second passageway. One of the first or second passageways is used for dry media and the other of the passageways is used for wet media. The first and second sides of the multi-purpose floor cleaning tool are offset about 90° from one another requiring re-positioning of the tool with respect to the first or second side, in operating the tool as a wet media or dry media floor cleaning tool. The adapter permits releasable engagement, disengagement and re-engagement to the floor cleaning tool for re-orientation of the same components and use of the tool for use as either a dry media or a wet media floor cleaning tool.

Other and further objects and advantages will become more apparent from the ensuing description.

BRIEF DESCRIPTION OF THE DRAWINGS

In the drawings

Corresponding reference numerals are used throughout the various figures of the drawings.

BRIEF DESCRIPTION OF THE PREFERRED EMBODIMENT

As will become apparent from the description that follows, the multi-purpose floor cleaning tool 1 of the present invention is used for dry media cleaning of floors and carpets, as well as wet media cleaning of the floors. Thus, the multi-purpose floor cleaning tool 1 is a single tool which performs all of the foregoing functions, whereas current floor cleaning tools require 3 separate and individual tools for achieving the same function and results as the single multi-purpose floor cleaning 1 of the present invention.

Figure 1:
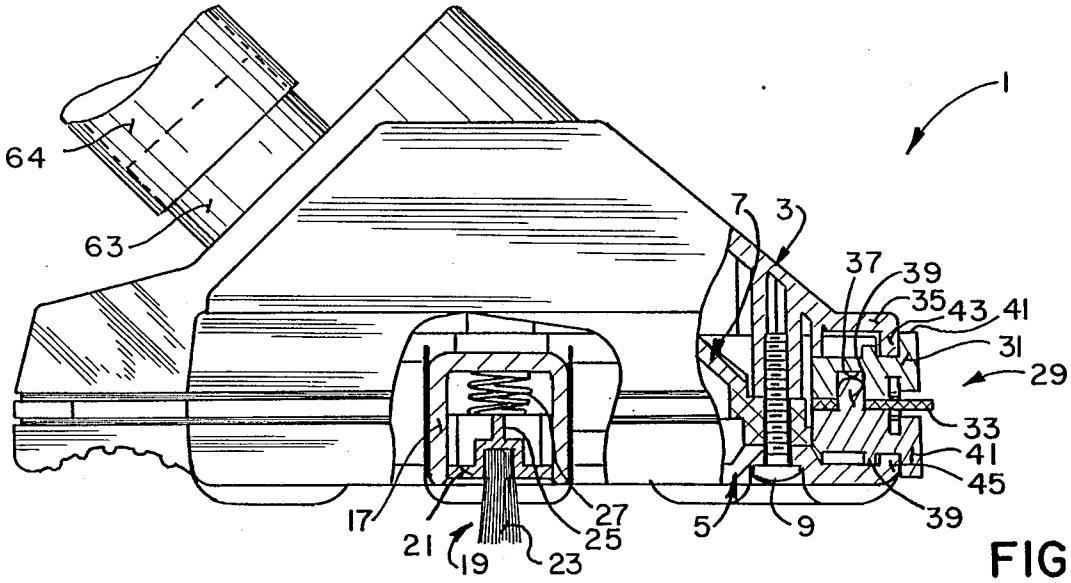
FIG. 1 is a side elevational view, partly in section, of the multi-purpose floor cleaning tool which is constructed in accordance with the teachings of the present invention.
Figure 2:
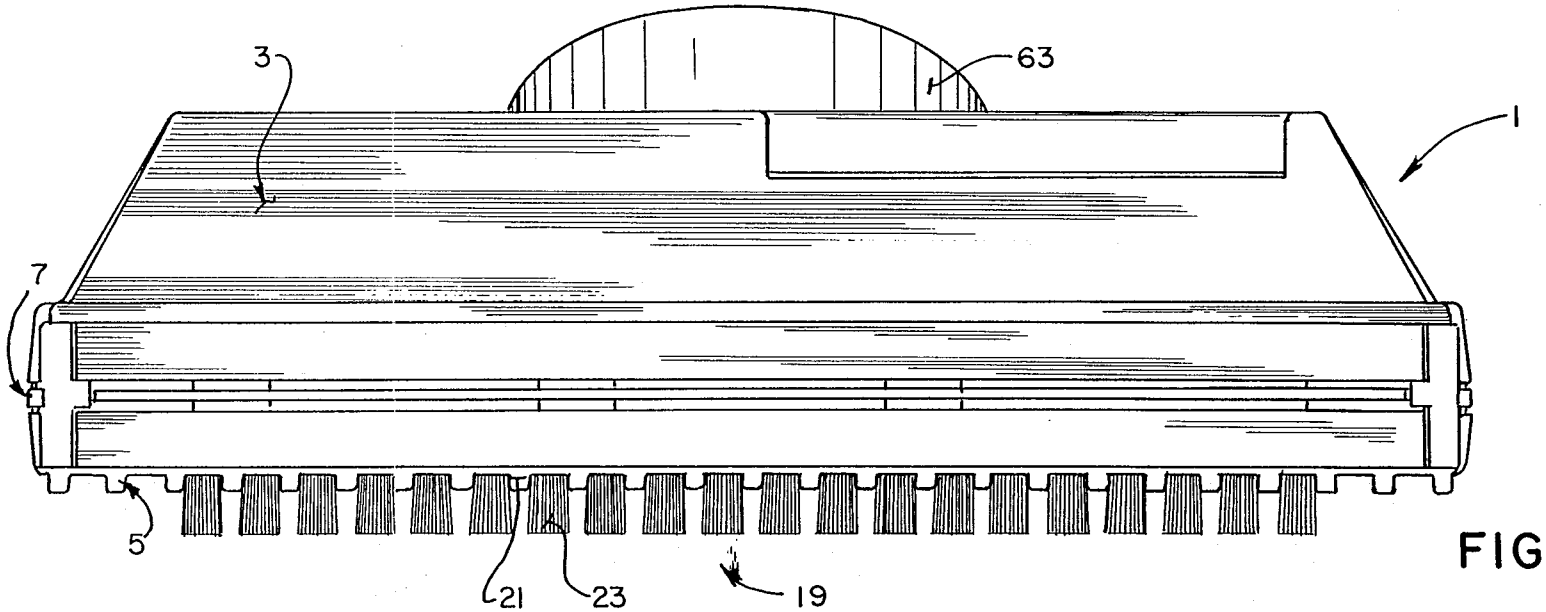
FIG. 2 is a side elevational view of the multi-purpose floor cleaning tool illustrated in FIG. 1 of the drawings.
Figure 5:
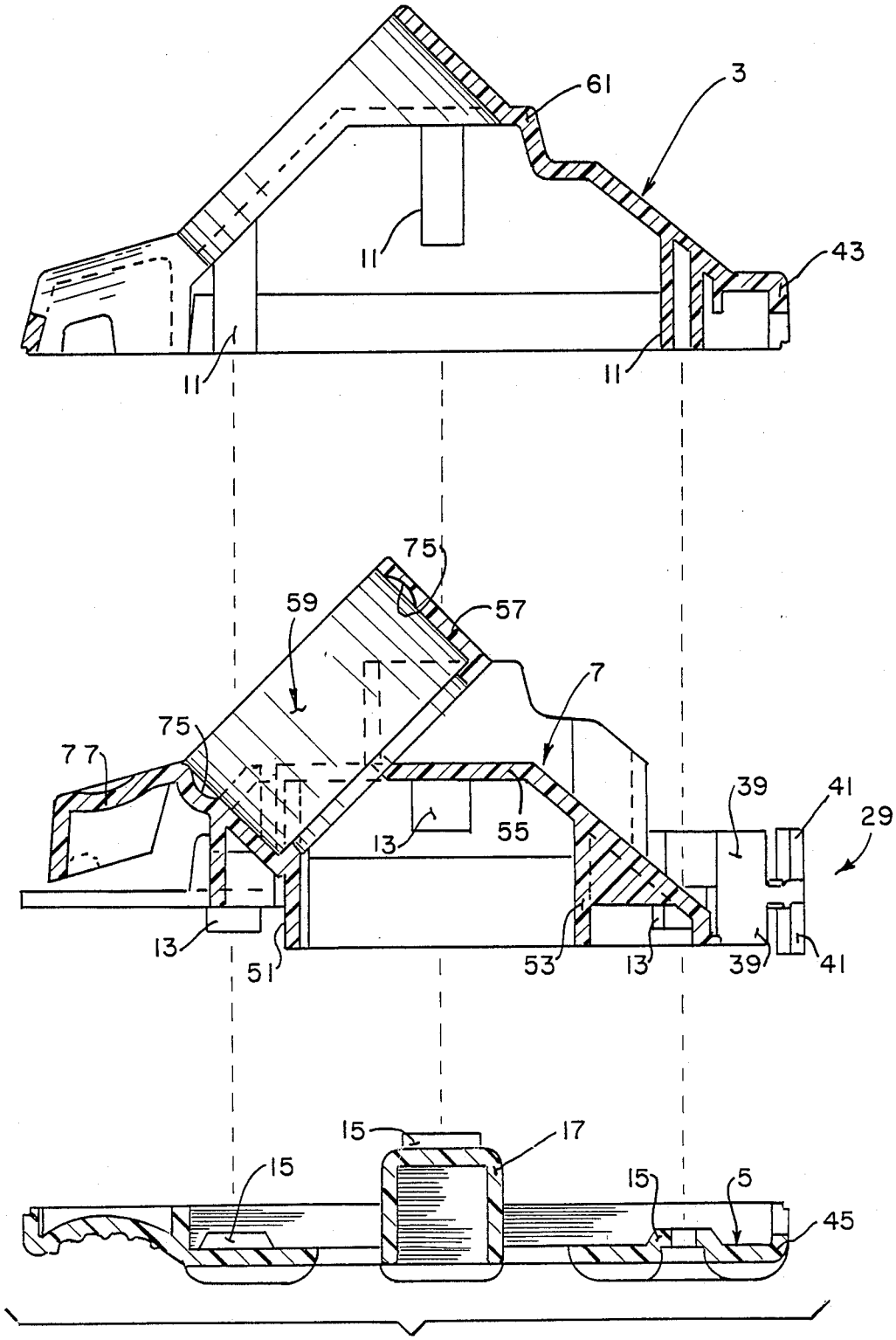
FIG. 5 is an exploded side elevational view, partly in section, illustrating the upper and lower housings and the intermediate baffle structure comprising the principal components of the multi-purpose floor cleaning tools.

As shown in FIGS. 1–2 and 5, the multi-purpose floor cleaning tool 1 has a housing assembly including the upper housing 3, the lower housing 5 and the intermediate baffle structure 7, which are secured together by the fasteners 9 that extend through aligned apertures and integral bosses 11, 13 and 15 of the upper housing 3, intermediate baffle structure 7 and lower housing 5, as best seen in FIG. 5 of the drawings. Dotted extension lines between the upper housing 3, the lower housing 5 and the intermediate baffle structure 7, in FIG. 5 of the drawings, represent alignment of a series of upper housing apertured bosses 11, intermediate baffle structure apertured bosses 13 and lower housing apertured bosses 15, permitting corresponding fasteners 9 to extend therethrough for holding these components together. Since the upper housing 3, lower housing 5 and intermediate baffle structure are preferably formed from a plastic material such as polypropylene, the fastener 9 are preferably thread cutting fasteners that form their own threads in the material surrounding the aligned apertures in the integral bosses 11, 13 and 15 of the upper housing 3, intermediate baffle structure 7 and lower housing 5.

The lower housing 5 includes an elongated generally U-shaped or channel-shaped member 17 that extends for substantially the entire width of the multi-purpose floor cleaning tool 1 for receiving the brush assembly 19 therein. The brush assembly 19 includes a brush holder 21 having a series of closely spaced tufts of nylon thistles 23, integrally molded in-situ within the brush holder 21, as will be understood. Extending in an opposite direction from the tufts of nylon thistles 23 is a stud 25 that is integrally molded to the brush holder 21 and receives the compression spring 27 thereon. Thus, the brush holder 21 is slidably received within the U-shaped or channel-shaped elongated member 17 for resilient or biasing movement of the brush holder 21 and tuffs 23 of nylon bristles, to conform to the floor or carpet surface over which the multi-purpose floor cleaning tool 1 is moved.

The brush assembly 19 extends along the lower bottom or side of the multi-purpose floor cleaning tool 1 in order to assist in sweeping or collecting dry media into a dry media passageway within the tool as, will soon be described. An adjacent side of the multi-purpose floor cleaning tool 1, offset about 90° from the bottom side thereof, includes a squeegee assembly 29, including a squeegee holder 31 and a squeegee element 33 that is held in place by the squeegee holder 31. Squeegee holder 31 includes integral male stud 35 and corresponding complementary opening 37 for aligning the squeegee holder 31 with the squeegee element 33 therewithin. The squeegee holder 31 further includes spaced shoulders 39, 41 which extend on opposite sides of a depending flange 43, associated with the upper housing 3, as well as on opposite sides of an upwardly extending flange 45 associated with the lower housing 5, as best seen in FIG. 1 of the drawings. Thus, the squeegee holder 31 is mounted with respect to the upper and lower housing 3, 5 and, in turn, the squeegee element 33 extends outwardly from the tool 1 for engaging a floor surface.

Figure 3:
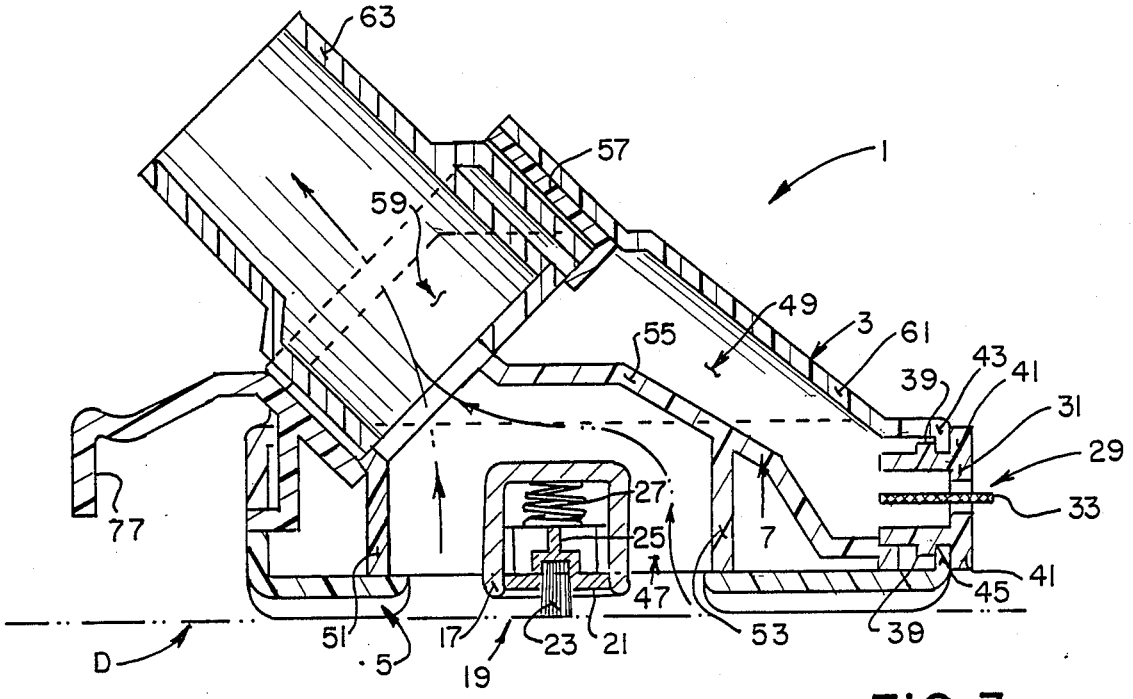
FIG. 3 is a front vertical sectional view of the multi-purpose floor cleaning tool and illustrating the use of the tool in collecting dry media.

The brush assembly 19 engages a floor surface when the multi-purpose floor cleaning tool 1 is operated in the position shown in FIGS. 1–3 of the drawings. When so operated, the squeegee assembly 29, including the squeegee element 33 is in non-engaging or noncontacting engagement relative to a floor surface, as will be appreciated. However, when the multi-purpose floor cleaning tool 1 is rotated 90° offset from the FIG. 1–3 orientation of the multi-purpose floor cleaning tool 1, to the position as shown in FIG. 4, for example, the squeegee assembly 29, including the squeegee element 33, is then brought into contacting engagement relative to a wet floor surface, enabling the squeegee element 33 to assist in collecting wet media in another passageway of the multi-purpose floor cleaning tool.

Figure 4:
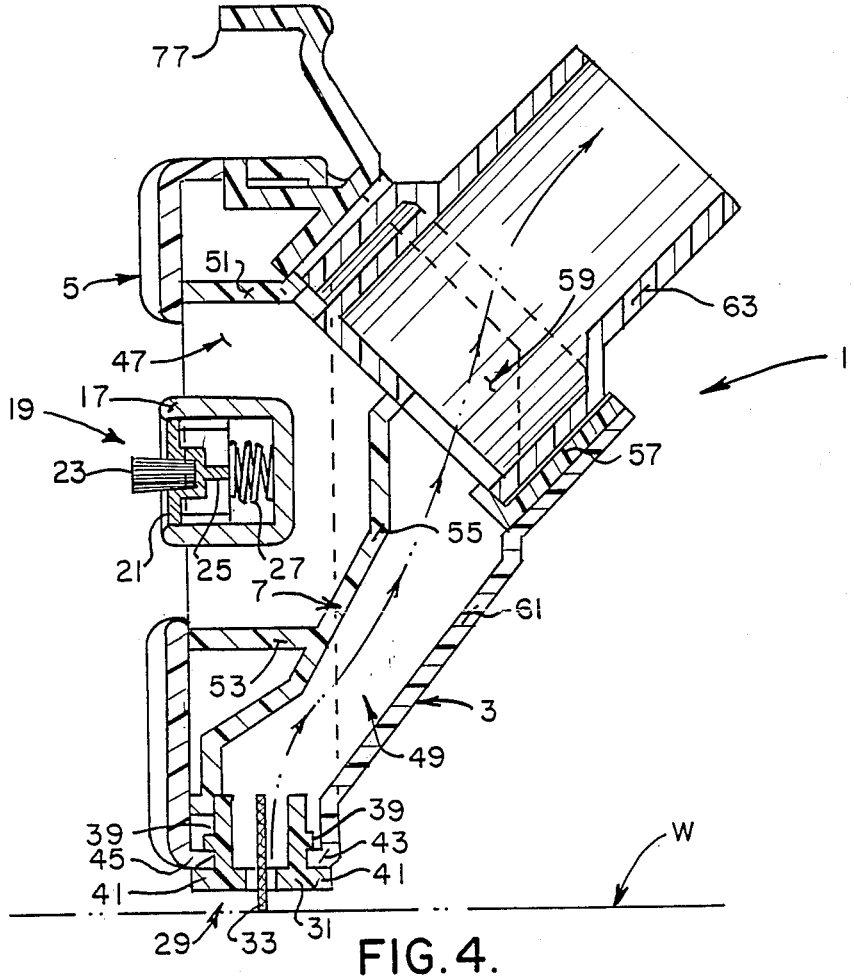
FIG. 4 is a vertical sectional view of the multi-purpose floor cleaning tool, oriented in a different position for collecting wet media.

As an important feature of the present invention, and as best seen in FIG. 3–4 of the drawings, the multi-purpose floor cleaning tool 1 incorporates both a dry media passageway 47 and a separate wet media passageway 49. FIGS. 3 and 5 of the drawings show that the dry media passageway 47 extends on opposite sides of the U-shaped or channel-shaped member 17 of the lower housing 5 and is defined by interior inner wall structure of the intermediate baffle structure 7 including generally vertically directed and spaced walls 51, 53, the later wall 53 being integrally connected to an upper wall 55 of the intermediate baffle structure 7 that extends first angularly upwardly from the vertically extending wall 53 and then generally horizontally. The upper end of the vertically extending wall 51 and the horizontally extending portion of the upper or top wall 55 are integrally attached to an elliptically-shaped, angularly offset circumferential wall structure 57. The area within the surrounding or circumferential wall structure 57 comprises a common channel 59 which communicates with the dry media passageway 47 along the open areas extending between the upper end of the vertically extending wall portion 51 and the inner end of the horizontally extending portion of the top or upper wall 55 of the intermediate baffle structure 7.

The wet media passageway 49 is defined by the upper or top wall 55 of the intermediate baffle structure 7 and the outer upper wall 61 of the upper housing 3. As can be seen in FIGS. 3 and 5 of the drawings, the upper or top walls 55 and 61 of the intermediate baffle structure 7 and upper housing 3 have a generally upwardly inclined relationship relative to one another. Of course, it will be recognized that areas thereof, which are in the vicinity of the squeegee holder 29, are horizontally directed for complementary interengagement with the squeegee holder 29, as described above. The free end of the top or upper wall 61 of the upper housing 3 is also angularly directed, but is also generally parallel to the channel surrounding wall structure 57 in overlying complementary engagement therewith, when the upper and lower housing and intermediate baffle structure 3, 5, and 7, respectively, are assembled to one another.

As shown in FIG. 3, when the multi-purpose floor cleaning tool 1 is used for cleaning a dry floor surface D, the multi-purpose floor cleaning tool 1 is oriented as shown in FIG. 3 of the drawings to enable the dry media passageway 47 to communicate with the lower half of the common channel 59. Where, on the other hand, the multi-purpose floor cleaning tool 1 is desired to be used for picking up or collecting wet media from the floor W shown in FIG. 4 of the drawings, the multi-purpose floor cleaning tool 1 is reoriented approximately 90° offset from the position shown in FIG. 3 of the drawings to enable the squeegee element 33 to come in contact with the floor surface W, while allowing wet media to be collected and moved up through the wet media passageway 59 for communication with the common channel 59.

Figure 6:
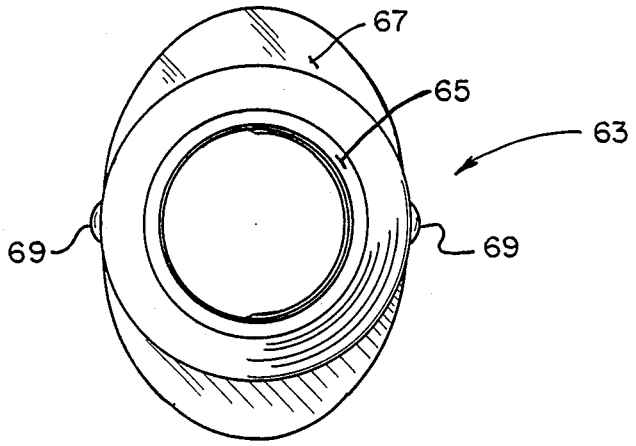
FIG. 6 is top plan view of one form of adapter used with the multi-purpose floor cleaning tool of the present invention.
Figure 7:
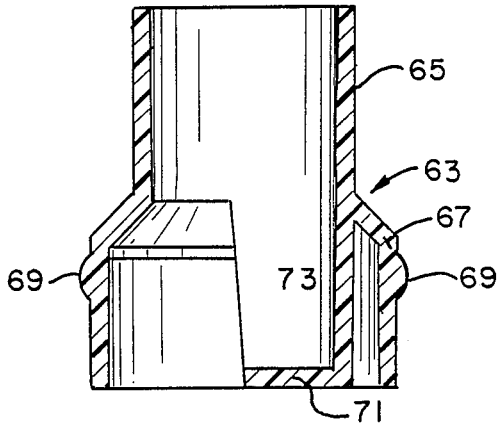
FIG. 7 is a vertical sectional view of the adapter shown in FIG. 6.
Figure 8:
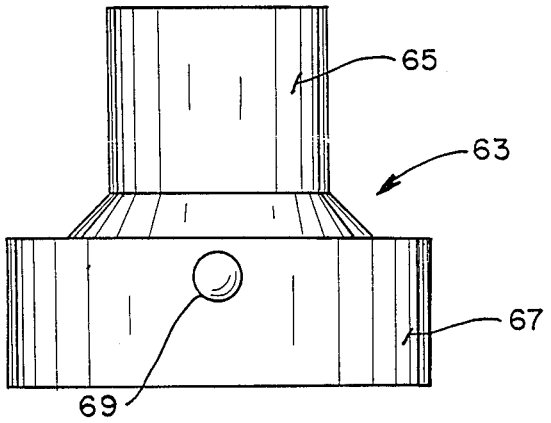
FIG. 8 is a side elevational view of the adapter shown in FIGS. 6–7 of the drawings.

In order to allow the multi-purpose floor cleaning tool 1 to be used for collecting dry media through the dry media passageway 47 and then be re-positioned to collect wet media through the wet media passageway 49, the adapter 63 is provided. The adapter 63 is best shown in FIGS. 6–8 of the drawings as including a one-piece integrally molded body, preferably made from polypropylene material, as well. The adapter 63 includes an upper tubular wall section 65 over which a vacuum hose or line 64 is assembled, as will be understood. A circumferentially extending flange 67 provided at the lower end of the adapter 63 includes integral ball detents 69 for purposes soon to be described. The adapter 63 further includes an internal throat restricting wall 71 which extends transverse to the tubular wall section 65 and is connected to a vertical extension thereof, as best shown in FIG. 7 drawings. It will be further noted that the circumferential flange 67 of the adapter 63 is generally elliptically shaped for complementary interfitting engagement within the common channel supporting structure 57 of the intermediate baffle structure 7. The channel supporting structure 57, as best seen in FIG. 5 of the drawings, has depressions 75, on opposite sides thereof, for engaging the generally opposed ball detents 69 of the adapter 63 for releasable engagement of the adapter 63 within the common channel supporting structure 57 of the intermediate baffle structure 7.

As will be appreciated, the spaced circumferential flange 67 of the adapter 63 is capable of flexing relative to the tubular wall 65 thereof, for releasable engagement and disengagement relative to the common channel supporting structure 57. The aforementioned construction of the multi-purpose floor cleaning tool 1 is such as to enable the adapter 63 to be rotated 180°, and re-inserted within the common channel supporting structure 57, to convert the multi-purpose floor cleaning tool 1 for dry media or wet media collections, as desired. In addition to this simple removal of the adapter 63 and 180° rotation thereof, when separated from the common channel supporting structure 57, the multi-purpose floor cleaning tool 1 must also be re-positioned or re-oriented from the dry media collection position, shown in FIG. 3 of the drawings, to the wet media collection position illustrated in FIG. 4 of the drawings.

In order to facilitate releasable engagement and disengagement of the adapter 63 relative to the common channel supporting structure 57, a finger element 77, integrally molded relative to the common channel supporting structure 57, temporarily deforms the common channel supporting structure 57, upon depression thereof, to allow the complementary ball detent and depressions 69, 75 to become disassociated from one another, in order to release the adapter 63 from the common channel supporting structure 57.

From the foregoing, it will now be appreciated that the multi-purpose floor cleaning tool 1 of the present invention may be used for both picking up or collecting wet or dry media in a dry media passageway 47 or in a separate wet media passageway 49, by simply withdrawing the adapter 63 from the common channel supporting structure 57 and rotating the adapter 180° for re-insertion within the common channel supporting structure 7. The internal throat restricting wall 71 of the adapter 63 will close off either the dry media passageway 47 or the wet media passageway 49, as the internal throat restricting wall 71 closes either the bottom half or the top half of the common channel 59. Dry media pick up or collection by the multi-purpose floor cleaning tool 1 is then made possible with the multi-purpose floor cleaning tool 1 positioned, as shown in FIG. 3 of the drawings, and wet media collection via media passageway 49 made possible by re-positioning the adapter 63 and re-orienting the multi-purpose floor cleaning tool 1, to the position shown in FIG. 4 of the drawings.

In view of the above, it will be seen that the several objects of the invention are achieved and other advantageous results are obtained.

As various changes could be made in the above construction without departing from the scope of the invention, it is intended that all matter contained in the above description or shown in the accompanying drawings shall be interpreted as illustrative and not in a limiting sense.

We claim:

1. A multi-purpose floor cleaning tool for use in picking up wet or dry media, comprising:

a first passageway connecting a first side of the tool to a vacuum line, a second passageway connecting a second side of the tool to said vacuum line, one of said passageways being used for dry media and the other of said passageways being used for wet media, the first and second sides of said tool being about 90° offset from one another requiring re-positioning of the tool with respect to the first and second side as desired, and an adapter for optionally closing off the second passageway during use of the first passageway or for closing off the first passageway during use of the second passageway, said adapter being interposed between said floor cleaning tool and said vacuum line in a common channel connecting said first and second passageways and including an internal throat restricting wall that closes off either the first or second passageway depending on the position of the adapter thereto, said adapter being capable of being rotated 180° for positioning the internal throat restricting wall of said adapter in a closed-off position relative to said first or second passageway, and one of said passageways used for dry media surrounding a floor engaging brush for sweeping dry media into said passageway, and said other passageway used for wet media including a squeegee for directing wet media into said passageway.

2. The multi-purpose floor cleaning tool as defined in claim 1 including an upper housing, a lower housing, and a baffle structure therebetween and being constructed and assembled to one another to provide the first passageway from said first side to said common channel and a second passageway from said second side to said common channel.

3. The multi-purpose floor cleaning tool as defined in claim 2 wherein said adapter includes an integrally molded opposing ball detent structure for complementary mating engagement with corresponding depressions provided in the supporting structure surrounding said common channel.

4. The multi-purpose floor cleaning tool as defined in claim 3 and including an integrally molded finger element associated with one of said opposing ball detent structure or complementary depressions, said finger element capable of being depressed to release said opposing ball detent structure and complementary depressions from each other.

5. The multi-purpose floor cleaning tool as defined in claim 4 wherein said integrally molded finger element extends outwardly from the supporting structure and surrounding said common channel for temporarily deforming said supporting structure to permit said opposing ball detent structure and complementary openings to become dissociated from one another for release of the adapter from said common channel.

6. The multi-purpose floor cleaning tool as defined in claim 5 wherein the air passageway volume of said passageway used for wet media continually decreases from said one side to said vacuum line to increase the velocity of incoming water and eliminate water back flow from said tool.

7. A multi-purpose floor cleaning tool for use in picking up of wet or dry media, comprising:

a housing assembly, including an upper housing, a lower housing and a baffle structure therebetween defining first and second separate passageways connected to a common channel in said housing assembly;

said first passageway connecting a first side of the housing assembly to said common channel;

said second passageway separately connecting a second side of the housing assembly to said common channel;

one of said passageways being used to collect dry media and the other of said passageways being used to collect wet media;

an adapter positioned with said common channel for optionally closing off the second passageway during use of the first passageway or for closing off the first passageway during use of the second passageway, said adapter including an internal throat restricting wall that closes off one of said passageways when aligned therewith, said adapter being capable of being rotated 180° for positioning the internal throat restricting wall of said adapter in a closed-off position relative to said first or second passageway;

a vacuum line connected to said adapter for establishing a partial vacuum in one or the other of said first and second passageways;

said first and second side of said tool being about 90° offset from one another requiring repositioning of the tool for using one of said passageways to collect dry media and the other of said passageways to collect wet media; and one of said passageways used for dry media surrounding a floor engaging brush for sweeping dry media into said passageway, and said other passageway used for wet media including a squeegee for directing wet media into said passageway.

8. The multi-purpose floor cleaning tool as defined in claim 7 wherein one of said passageways is connected to a lower half of said common channel and the other of said passageways is connected to an upper half of said common channel.

9. The multi-purpose cleaning tool as defined in claim 8 wherein said adapter is detachably connected relative to said common channel in two separate positions, one of said positions aligning said internal throat restricting wall to close off said first passageway and the other of said positions aligning said internal throat restricting wall to close off said second passageway.

10. The multi-purpose tool as defined in claim 9 wherein said adapter and common channel surrounding structure are provided with releasable ball detent and complementary depressions for releasable engagement of said adapter relative to said common channel surrounding structure, and an integrally molded finger element being associated with one of said adapter and common channel supporting structure for releasably disengaging said adapter from said common channel supporting structure.

11. The multi-purpose floor cleaning tool as defined in claim 4 wherein said integrally molded finger element extends outwardly from the common channel supporting structure for temporarily deforming same to permit said releasable ball detents and complementary depressions associated with said adapter and common channel supporting structure to become disassociated from one another for release of the adapter from said common channel.

* * * * *